US006886475B2

(12) United States Patent
Apps et al.

(10) Patent No.: US 6,886,475 B2
(45) Date of Patent: May 3, 2005

(54) PLASTIC PALLET

(75) Inventors: William P. Apps, Alpharetta, GA (US); Jeff Wilkerson, Grapevine, TX (US); Brian Musser, Nottingham, NH (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/347,712

(22) Filed: Jan. 19, 2003

(65) Prior Publication Data

US 2003/0106470 A1 Jun. 12, 2003

Related U.S. Application Data

(63) Continuation of application No. 09/439,427, filed on Nov. 15, 1999, which is a continuation of application No. 09/004,389, filed on Jan. 8, 1998, now Pat. No. 6,006,677.

(51) Int. Cl.[7] ..... B65D 19/38
(52) U.S. Cl. ..... 108/57.25; 108/902
(58) Field of Search ..... 108/51.11, 57.25, 108/57.26, 57.27, 901, 902

(56) References Cited

U.S. PATENT DOCUMENTS

| | | | | |
|---|---|---|---|---|
| 2,544,657 A | | 3/1951 | Cushman | |
| 2,599,076 A | | 6/1952 | Sturgis | |
| 2,699,912 A | | 1/1955 | Cushman | |
| 3,126,843 A | | 3/1964 | DeLaney | |
| 3,307,504 A | | 3/1967 | Cloyd et al. | |
| 3,346,902 A | | 10/1967 | Leventhal | |
| 3,467,032 A | | 9/1969 | Rowlands et al. | |
| 3,602,157 A | | 8/1971 | Cohen et al. | |
| 3,651,769 A | | 3/1972 | Foley | |
| 3,654,874 A | | 4/1972 | Skinner | |
| 3,664,271 A | * | 5/1972 | Wolder et al. | 108/57.26 |
| 3,678,868 A | | 7/1972 | Hirota | |
| 3,685,461 A | | 8/1972 | Belcher | |
| 3,710,733 A | | 1/1973 | Story | |
| D231,096 S | | 4/1974 | Adam | |
| D232,019 S | | 7/1974 | Rehrig et al. | |
| 3,824,933 A | | 7/1974 | Lind | |
| 3,835,792 A | | 9/1974 | Wharton | |
| 3,868,915 A | * | 3/1975 | Hafner | 108/57.26 |
| 3,878,796 A | | 4/1975 | Morrison | |
| 3,964,400 A | | 6/1976 | Brand | |
| 4,013,021 A | * | 3/1977 | Steinlein et al. | 108/57.25 |
| 4,051,787 A | | 10/1977 | Nishitani et al. | |
| D246,296 S | | 11/1977 | Fujii et al. | |
| 4,103,857 A | | 8/1978 | Levenhagen | |
| 4,183,491 A | | 1/1980 | Sanders et al. | |
| 4,287,836 A | | 9/1981 | Aoki | |

(Continued)

FOREIGN PATENT DOCUMENTS

| | | | |
|---|---|---|---|
| DE | 2 232 200 | | 1/1973 |
| DE | 2 733 457 | | 2/1979 |
| JP | 61 244479 | | 10/1986 |
| JP | 3-98854 | * | 4/1991 |
| JP | 3-226457 | * | 10/1991 |
| WO | WO 94/08861 | | 4/1994 |
| WO | WO 97/17263 | | 5/1997 |

OTHER PUBLICATIONS

EPC Loudon Brochure "Plastic Pallets for the Beverage Industry" dated Apr. 1997.

*Primary Examiner*—Jose V. Chen

(57) ABSTRACT

An improved pallet made of a synthetic resin wherein one of the underside of the upper deck and upperside of the lower deck is substantially planar, and the supports which separate the upper and lower decks are integrally formed with and project upwardly from the other side, and are secured to the one side. One of the ends of the supports are tapered and received in recesses in the one side, and the recesses and the supports preferably have mating elements which snap-actingly engage one another to lock the supports in the recesses when the decks are assembled.

35 Claims, 18 Drawing Sheets

U.S. PATENT DOCUMENTS 4,316,419 A 2/1982 Cupido
4,403,555 A 9/1983 Forrest
4,522,009 A 6/1985 Fingerson
4,597,338 A 7/1986 Kreeger
4,843,976 A * 7/1989 Pigott et al. ..... 108/56.1
5,197,395 A 3/1993 Pigott et al.
5,197,396 A * 3/1993 Breezer et al. ..... 108/56.3
D346,681 S 5/1994 Pigott et al.
D347,511 S 5/1994 Pigott et al.
5,343,814 A * 9/1994 Pigott et al. ..... 108/56.1
5,413,052 A * 5/1995 Breezer et al. ..... 108/56.1
D371,882 S 7/1996 Kristoffersson
5,666,886 A * 9/1997 Alexander et al. ..... 108/56.3
5,676,064 A 10/1997 Shuert
5,845,588 A 12/1998 Gronnevik
5,868,080 A 2/1999 Wyler et al.
5,887,529 A * 3/1999 John et al. ..... 108/56.1
6,006,677 A * 12/1999 Apps et al. ..... 108/57.25
6,029,583 A * 2/2000 LeTrudet ..... 108/57.25
6,199,488 B1 * 3/2001 Favaron et al. ..... 108/57.25

* cited by examiner

PLASTIC PALLET

CROSS-REFERENCE TO RELATED APPLICATION

This application is a continuation of co-pending application Ser. No. 09/439,427 filed Nov. 15, 1999, which is a continuation of Ser. No. 09/004,389 filed on Jan. 8, 1998, now U.S. Pat. No. 6,006,677.

BACKGROUND

This invention relates to pallets for supporting freight, goods or other materials, and more particularly to a pallet made of synthetic resin for use with a fork lift.

Pallets made of molded plastic material have distinct advantages over those made of wood or metal. Wood pallets are heavy; are subject to warpage, splintering and splitting; are nonuniform in strength; and gain significant weight when wet. Metallic pallets typically are expensive and, in the case of steel, heavy and subject to corrosion. Plastic pallets, while stronger, lighter and more durable than wooden pallets, nevertheless have shortcomings of their own.

In an effort to minimize mold costs, some plastic pallets have been designed as modular units which consist of a plurality of identical molded elements that are snapped, fused or otherwise secured together to make a complete pallet. Examples of this type of pallet are disclosed in U.S. Pat. Nos. 4,051,787; 4,597,338; and 5,197,395. However, this is a compromise scheme which usually yields a pallet that is made of more material (and is therefore heavier and has a higher material cost) than would be required if the upper and lower portions of the pallet were optimally designed to serve their diverse purposes.

Specifically, the top deck of a pallet should have relatively small openings so as to adequately support the load across substantially the entire upper surface of the pallet; it must be stiff enough (usually afforded by substantial ribbing) to prevent excessive bending, either when resting on the forks of a fork lift, or resting on the supports that separate the upper and lower decks; and its upper surface should not have recesses or crevices which could collect water or dirt. The top decks of the pallets disclosed in the aforementioned patents have these features. In contrast, the bottom of the pallet, which normally is intended to rest on a substantially solid surface, such as a floor, deck, shelf or rack, need not have as much material on its underside in contact with the supporting surface. Thus, the bottom deck of a plastic pallet may have relatively large openings, and may have exposed ribs, recesses and crevices on its underside, as long as the design provides adequate support for the loaded pallet. An upper pallet deck which is inverted to serve as a lower deck thus would have more material than actually required to perform the functions of a lower deck.

FIGS. 8–19 of U.S. Pat. No. 4,051,787 depict examples of a pallet which has relatively large openings in its bottom deck. However, the structure surrounding these openings appears to be quite thick and massive, with a large, closed bottom surface area that would contact a supporting surface. The bottom deck thus would appear to contain more material than is actually required.

Some pallets which comprise identical molded halves require a plurality of separate fastening elements to secure the halves together. U.S. Pat. Nos. 2,699,912 and 5,197,395 disclose examples of these types of pallets. The use of separate fastening elements introduces added cost and assembly time to pallet construction.

Efforts to minimize the amount of plastic material used in a pallet have led some to devise hybrid constructions wherein discrete reinforcing rods are integrated onto the molded pallet. An example is disclosed in U.S. Pat. No. 4,316,419, which uses metal reinforcing rods that are inserted into channels molded into the pallet. The problem with these types of pallets is that they require separately manufactured additional components, and additional assembly steps.

Another problem with plastic pallets in general is that their surfaces tend to be slippery. Measures must be taken to prevent the load from sliding off the pallet; to keep stacked pallets, whether loaded or not, from sliding off one another; and to keep the pallet from sliding off the forks of the fork lift. Common anti-slip measures involve the use of anti-slip coatings or rubber inserts, such as pads or grommets, placed in strategic locations. Examples are shown in FIGS. 20–25 of U.S. Pat. No. 4,051,787. One problem with these anti-slip measures is that they require the installation of additional parts or materials. Further, anti-slip coatings can wear away, while inserts can work loose and fall off during use, rendering them ineffective.

In the bottled beverage industry, filled and capped bottles are placed in bottle crates, which are loaded onto pallets and moved about using a fork lift. The crates typically are of the low depth variety, such that the bottles project above the upper edges of the crates. As long as the bottles are of uniform height, it is desirable to stack several loaded pallets on top of one another so that they can be moved about collectively by fork lift, and efficiently stored in a stacked configuration either on a floor or on a shelf or rack. The bottom deck of the pallet must be designed so that the load of one pallet is evenly distributed over the closures of the bottles on the subjacent pallet. Existing pallet constructions do not adequately address this need.

SUMMARY OF THE INVENTION

It is, therefore, an object of the present invention to provide a rigid, durable plastic pallet that can be fabricated from just one type of material without using an excessive amount of that material.

It is another object of the invention to provide a plastic pallet which comprises a minimum number of parts, and does not require separate fasteners to secure the pallet parts together, so as to simplify pallet assembly.

Another object of the invention is to provide a plastic pallet which is suitable for use in the bottled beverage industry, allowing one loaded pallet to be stacked on and supported by the bottles carried by a subjacent pallet.

A further object of the invention is to provide a plastic pallet that possesses sufficient anti-slip characteristics in the critical load-contacting, fork-contacting and bottom support regions without resort to the application or attachment of diverse anti-slip elements or materials.

These and other objects are achieved by providing an improved pallet made of a synthetic resin wherein the underside of the upper deck is substantially planar, and the supports that separate the upper and lower decks are integrally formed with and project upwardly from the lower deck, and are secured to the underside of the upper deck.

The upper ends of the supports preferably are received in recesses in the underside of the upper deck, and the recesses and the supports preferably have mating elements which snap-actingly engage one another to lock the supports in the recesses when the decks are assembled.

Preferably, the supports are tapered, the lower ends of the supports being wider than the upper ends thereof. The supports are hollow and have internal upright stiffening ribs which project inwardly from the side wall of the support.

In a preferred embodiment, the pallet is rectangular and has nine supports, the largest one located at the center, one located at each corner, and located one at the middle of each side, so as to form a four-way pallet which can be engaged by a fork lift from any side. The bottom deck comprises a rectangular perimeter base from which the perimeter supports project, and an integrally formed X-shaped central base from which the central support projects, the central base joining with the perimeter base medially of each side thereof. These base portions define four large openings through the bottom deck, and preferably are beveled on their edges. Reinforcing ribs on the underside of the base portions are more closely spaced in the regions beneath the supports.

In another aspect of the invention, an improved synthetic resin pallet is provided wherein the top surface of the upper deck, the bottom surface of the lower deck, and the underside of the upper deck in the fork-receiving regions between the supports have a slip-resistant scuffed texture. Preferably the scuffed texture comprises a multidirectional scuffing pattern. A preferred method of creating such a scuffing pattern is by brushing the surfaces with at least one cup-shaped wire brush.

BRIEF DESCRIPTION OF DRAWINGS

A preferred embodiment of the invention is described in detail below and illustrated in the accompanying drawings, in which.

DETAILED DESCRIPTION

Figure 1:
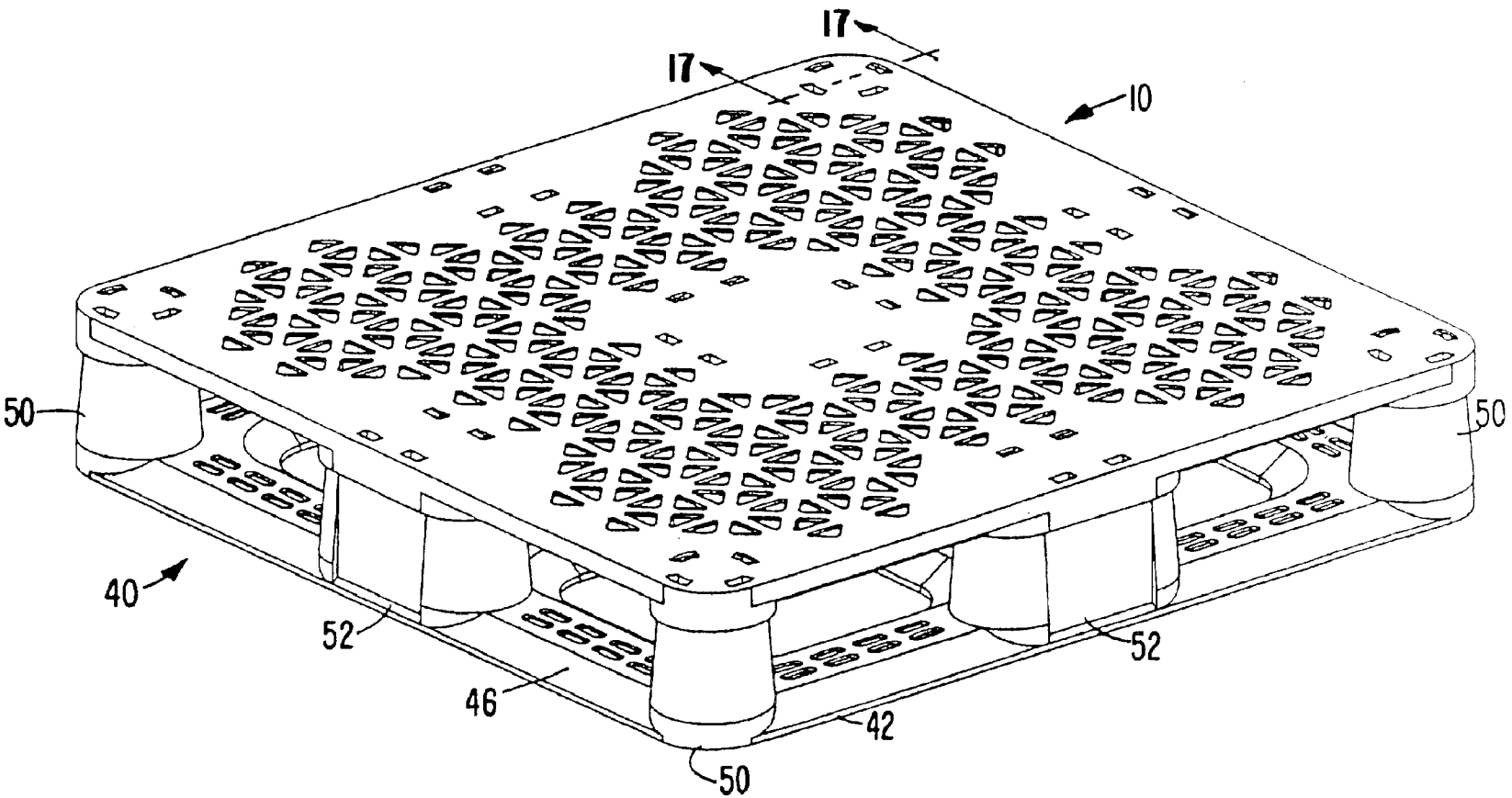
FIG. 1 is a top perspective view of a preferred embodiment of an assembled pallet according to the invention.
Figure 2:
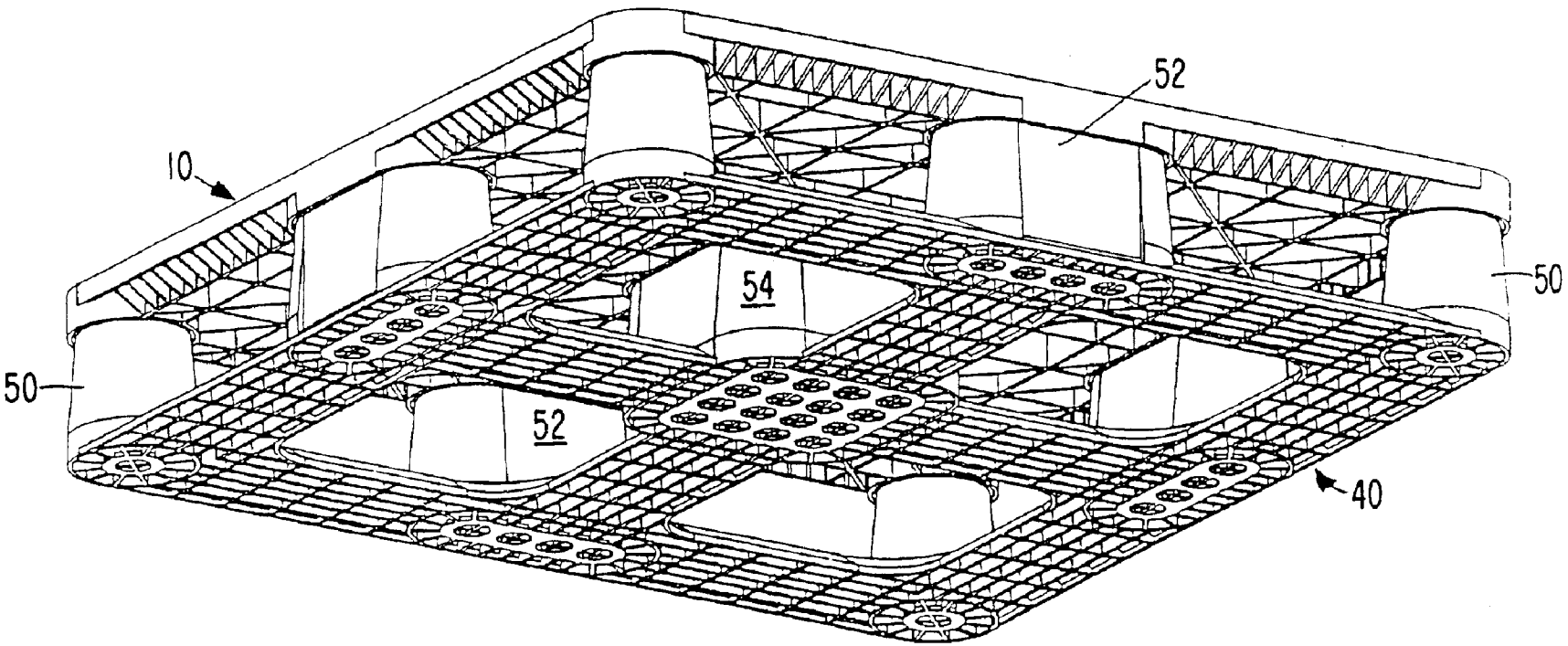
FIG. 2 is a bottom perspective view of the pallet of FIG. 1.
Figure 3:
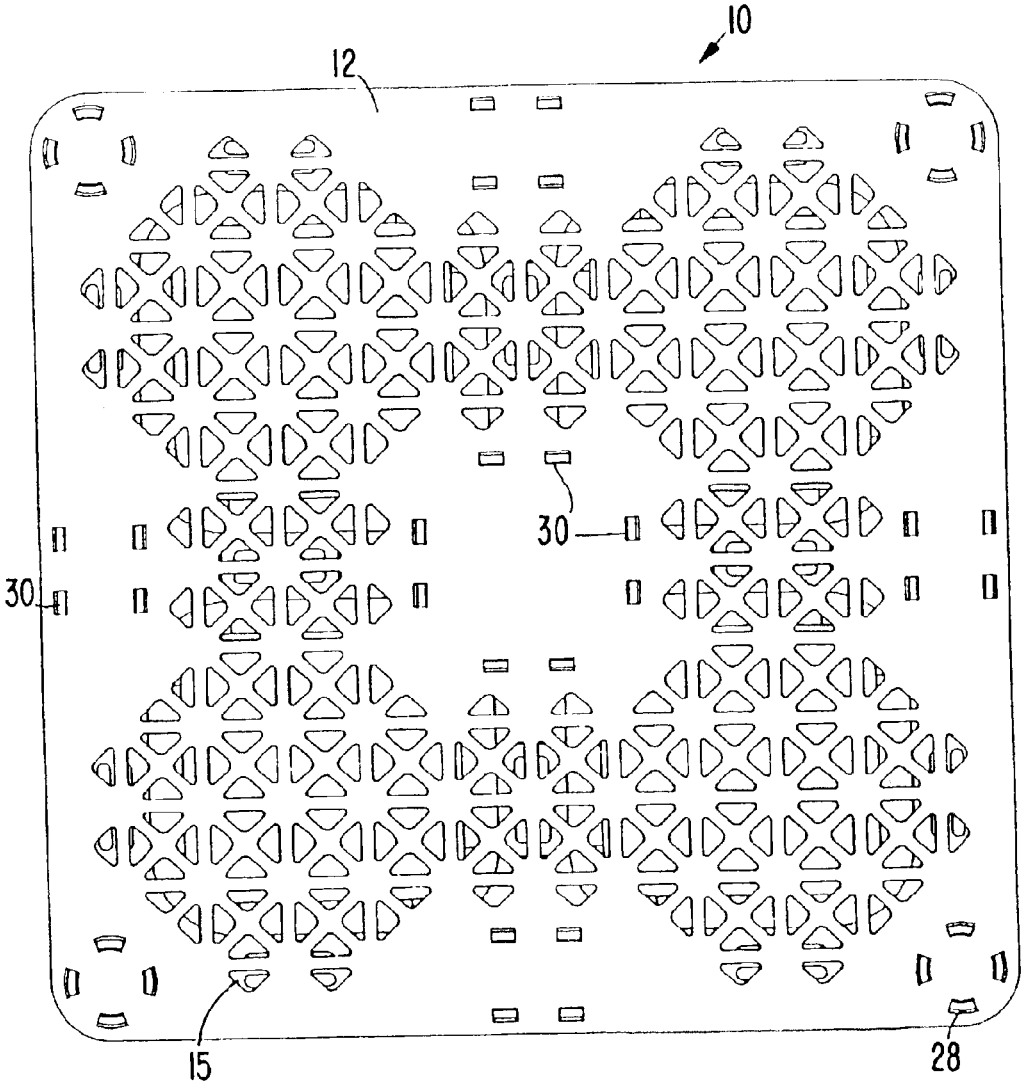
FIG. 3 is a top plan view of the pallet of FIG. 1.
Figure 4:
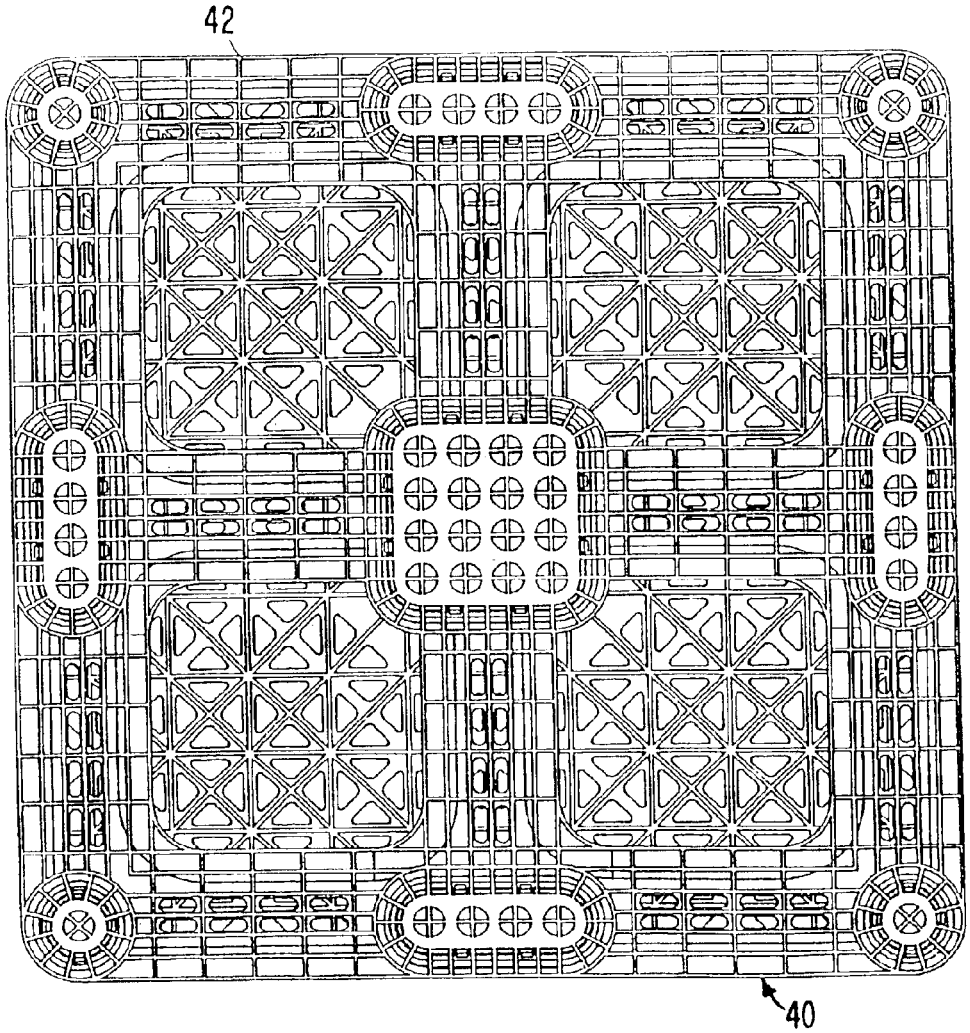
FIG. 4 is a bottom plan view of the pallet of FIG. 1.
Figure 5:
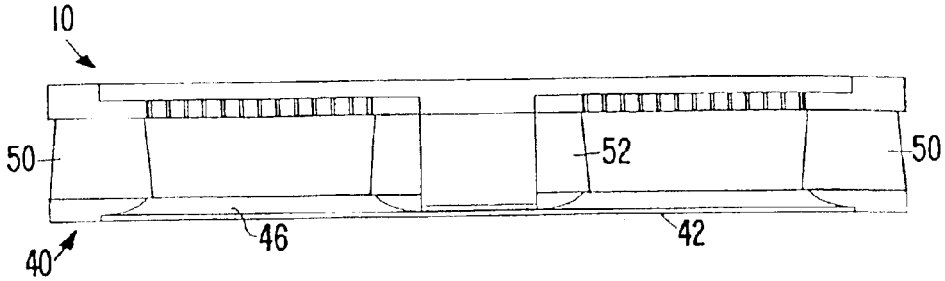
FIG. 5 is a side elevational view of the pallet of FIG. 1, all of the sides being identical.
Figure 8:
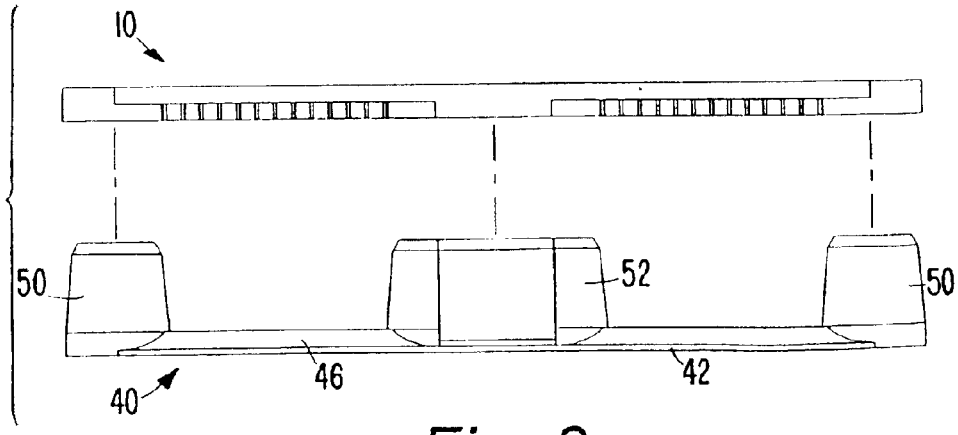
FIG. 8 is a side elevational, exploded view of the pallet of FIG. 6.
Figure 6:
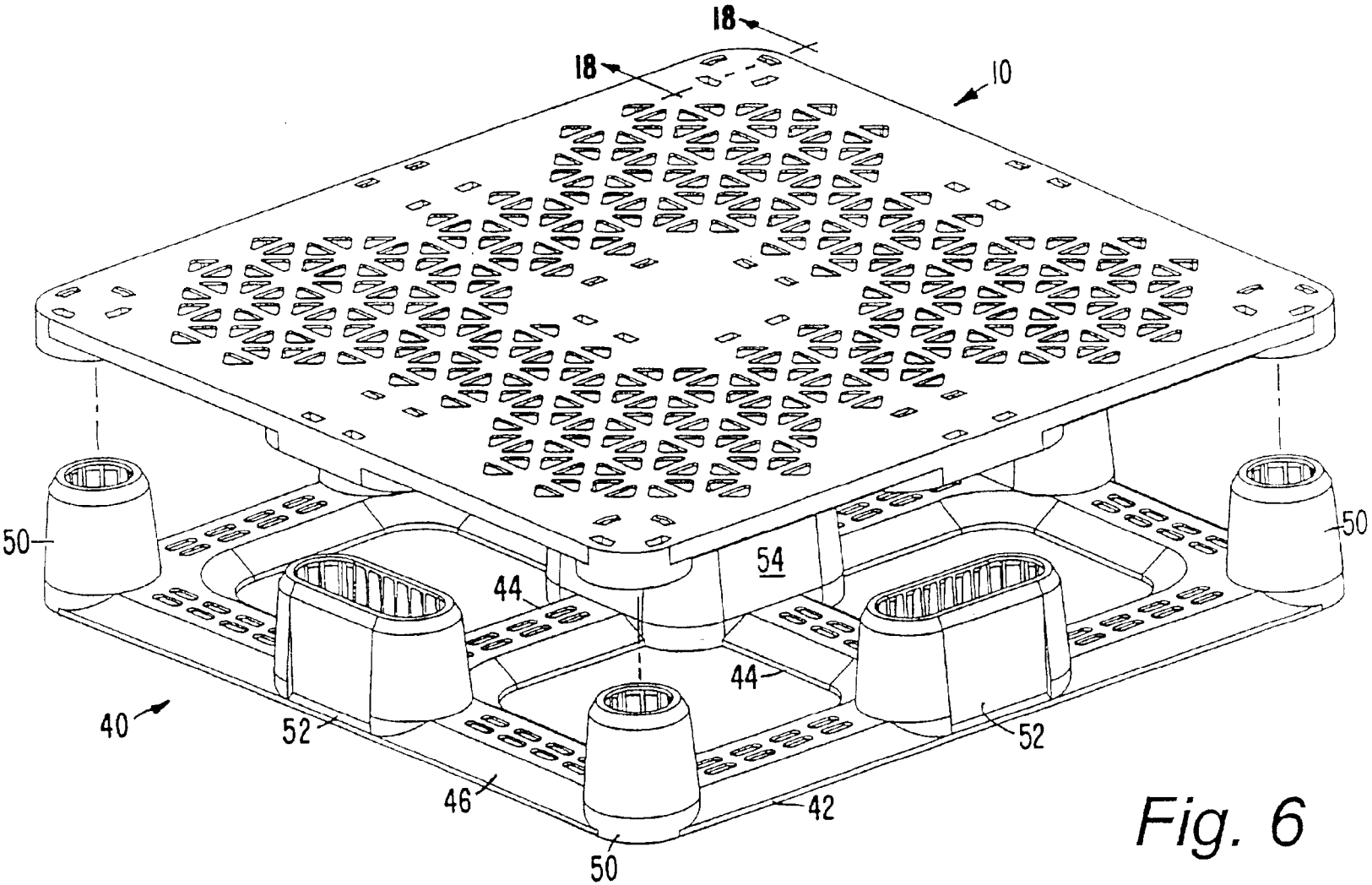
FIG. 6 is a top perspective, exploded view of the pallet of FIG. 1, showing the upper and lower decks juxtaposed for assembly.
Figure 7:
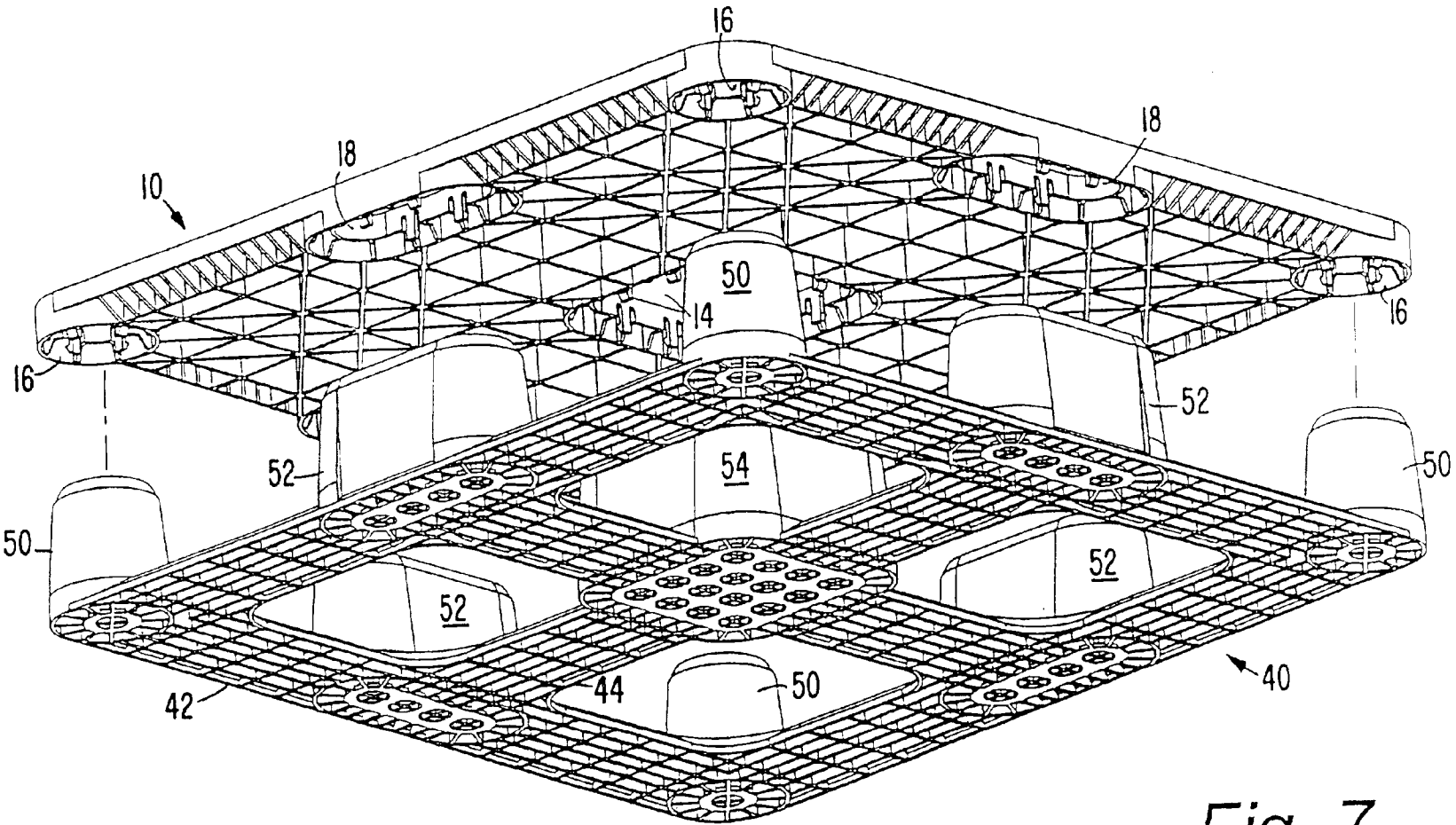
FIG. 7 is a bottom perspective, exploded view of the pallet of FIG. 6.
Figure 9:
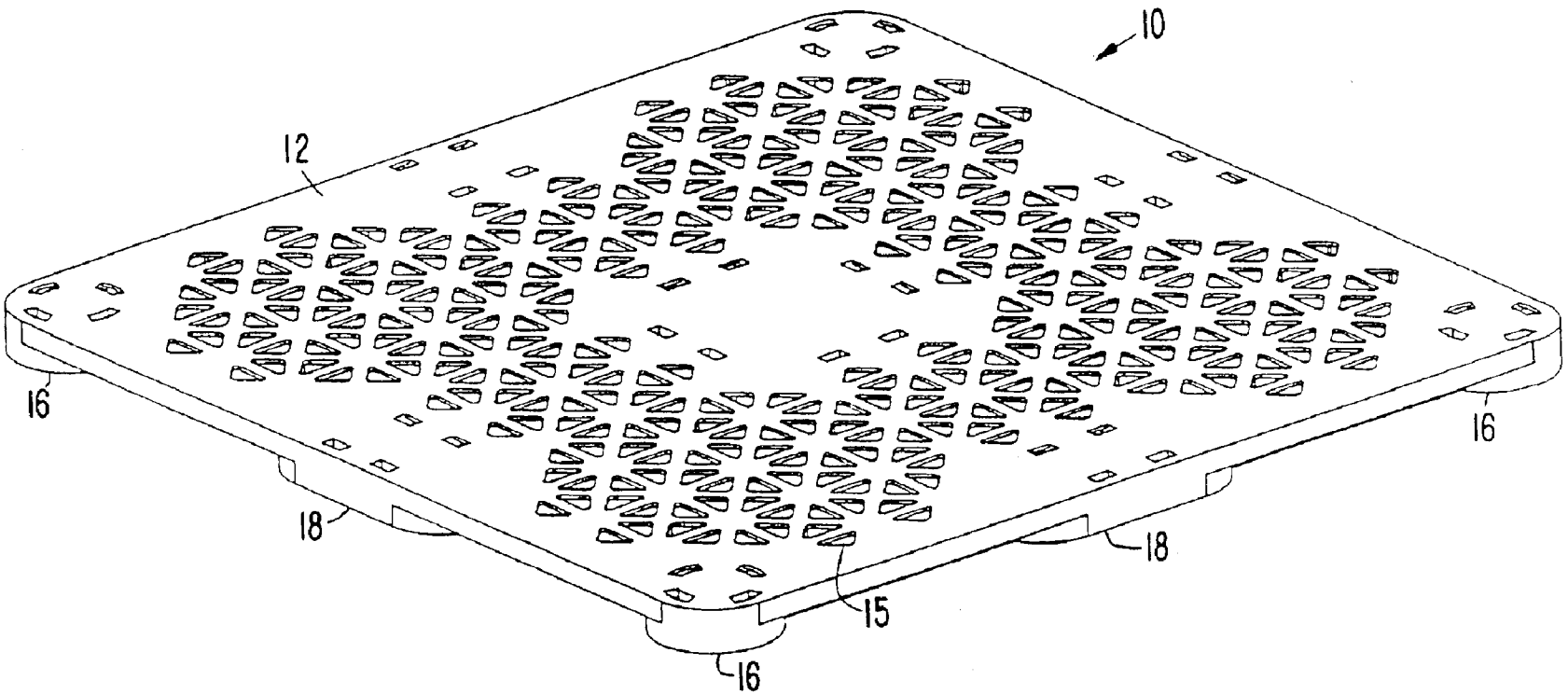
FIG. 9 is a top perspective view of the upper deck of the pallet of FIG. 6.

The pallet consists of two separately molded parts—an upper deck 10 and a lower deck 40—which are injection molded of a suitable synthetic resin, such as high density polyethylene, polypropylene, or filled polypropylene. In plan view, the pallet is square, with rounded corners, and has four-way symmetry. As explained more fully below, the two decks are adapted to be easily snapped together to form the finished pallet illustrated in FIGS. 1–5. FIGS. 6–8 illustrate how the two decks are aligned for assembly. For added rigidity, the decks may be permanently welded together using any known resin welding technique.

FIGS. 9–12 depict the upper deck 10. This deck has a solid top surface 12 interrupted by a series of triangular holes 15, which reduce the weight of the deck and allow for drainage in the event the pallet becomes wet.

Figure 10:
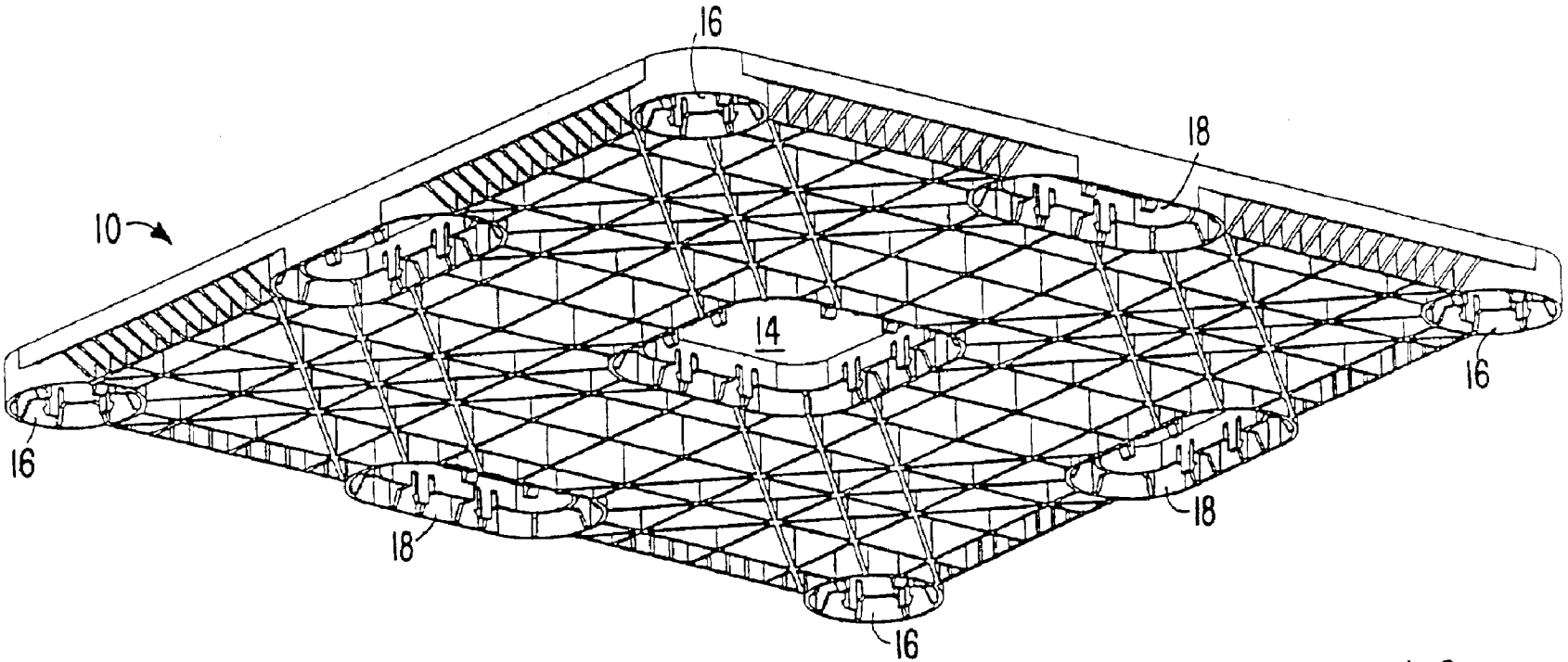
FIG. 10 is a bottom perspective view of the upper deck of FIG. 9.
Figure 11:
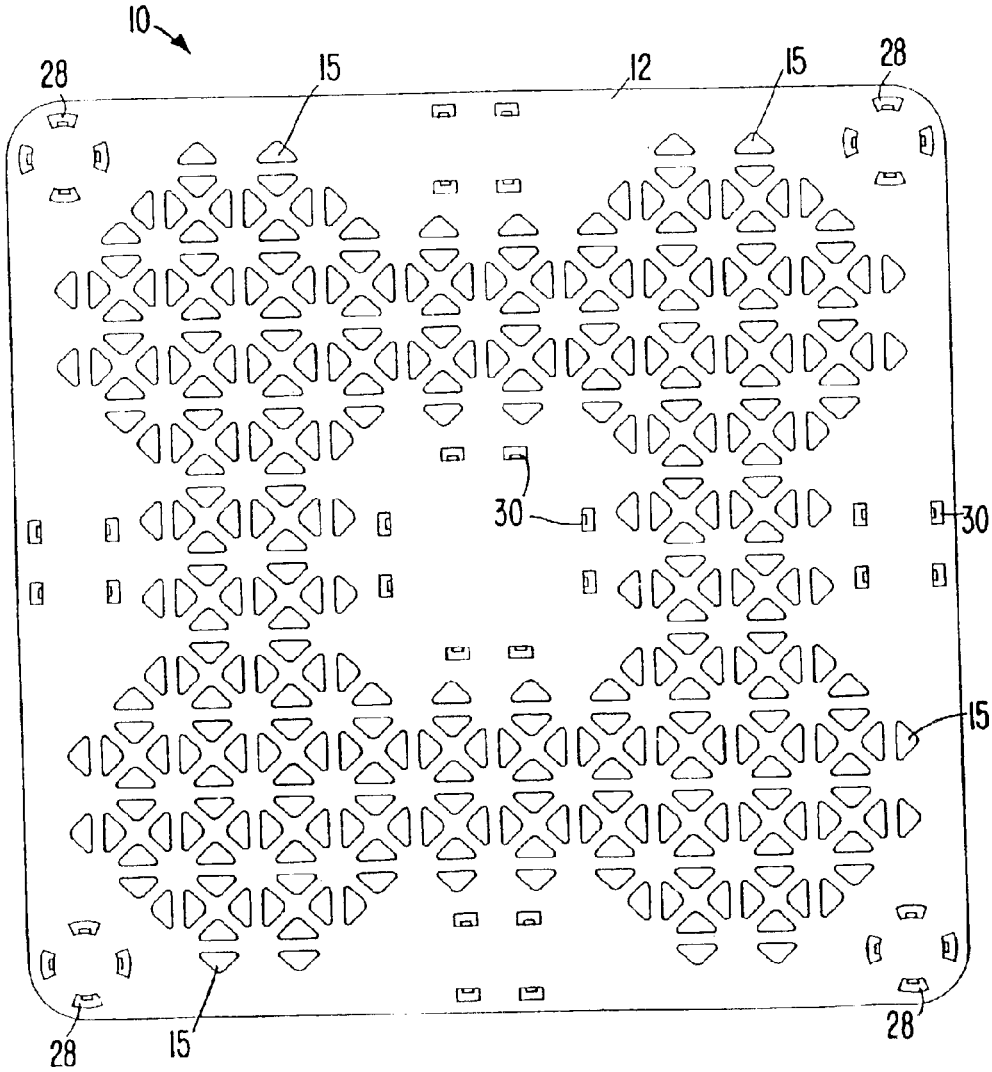
FIG. 11 is a top plan view of the upper deck of FIG. 9.
Figure 12:
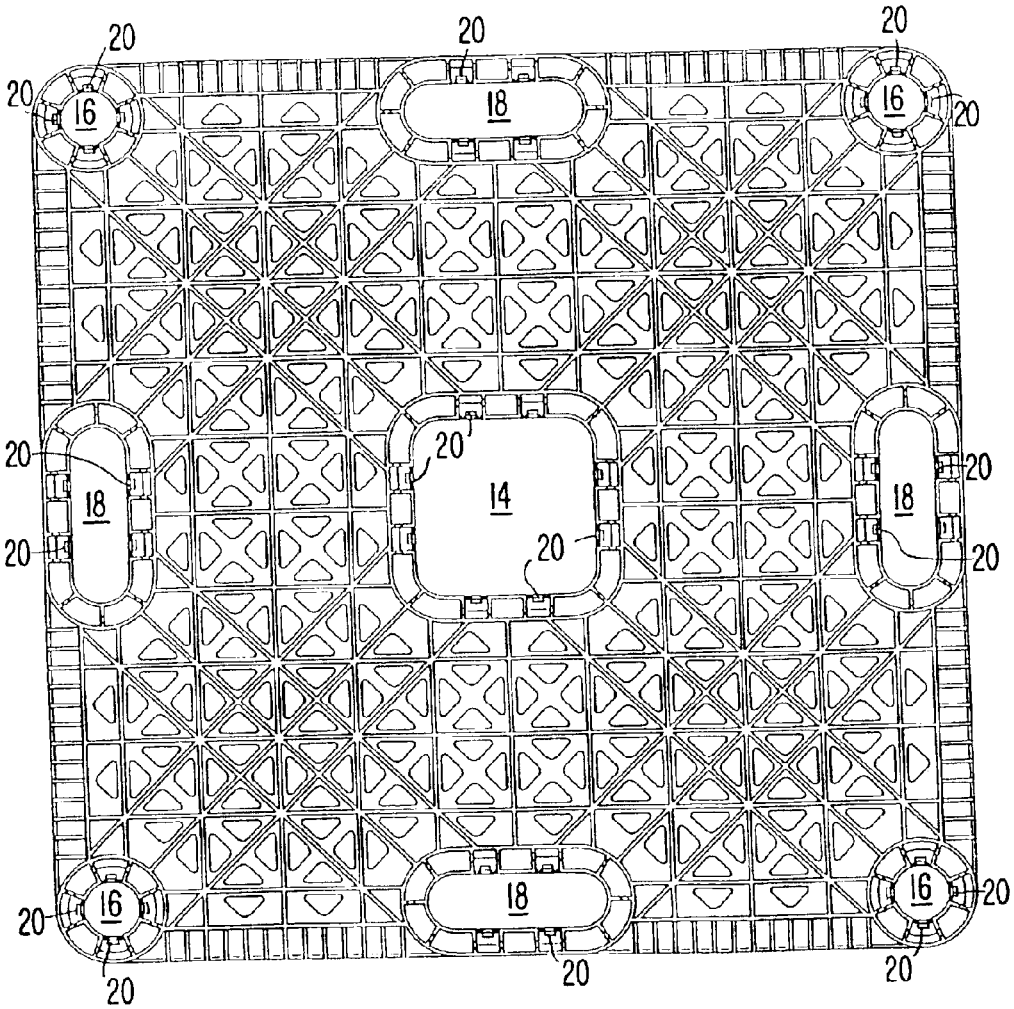
FIG. 12 is a bottom plan view of the upper deck of FIG. 9.
Figure 13:
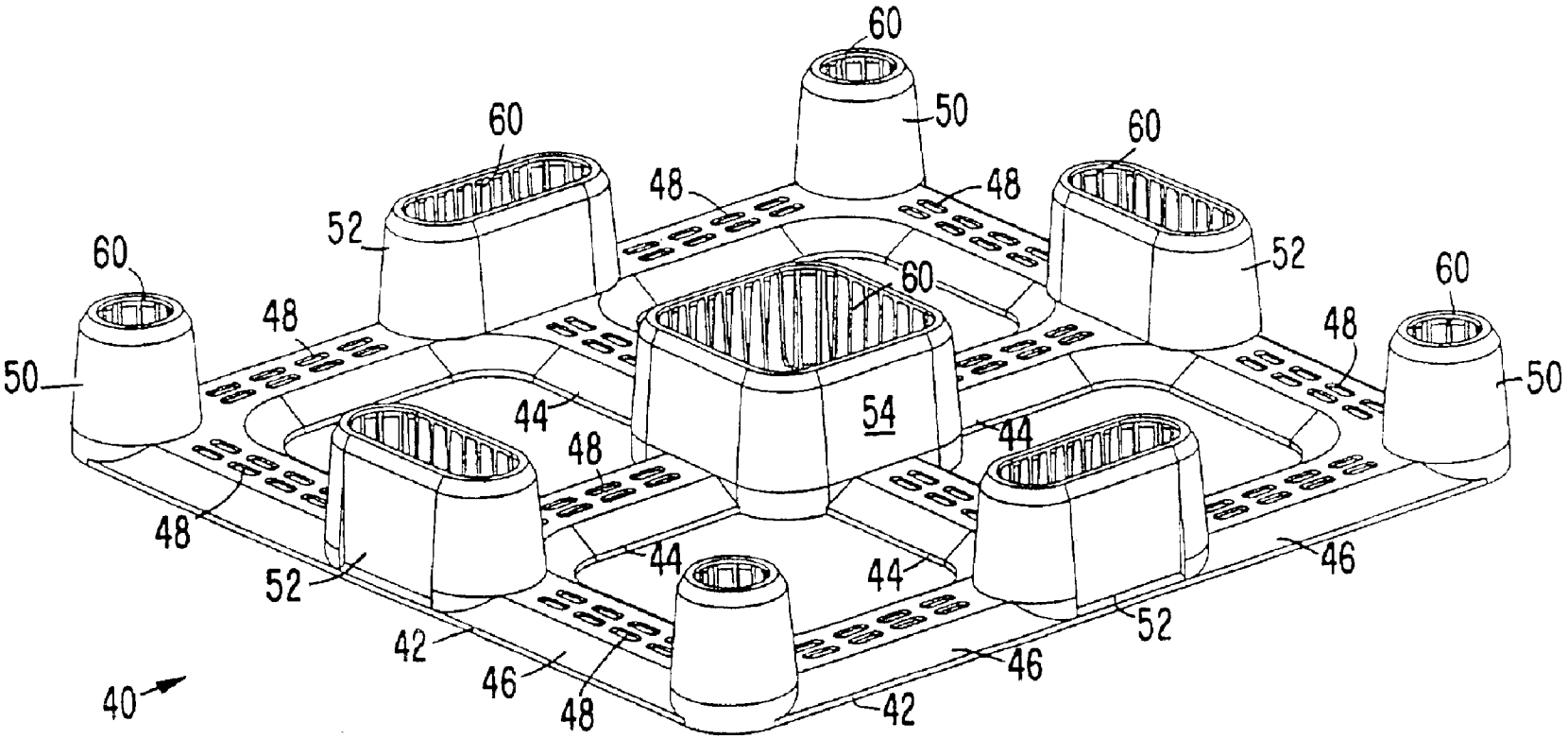
FIG. 13 is a top perspective view of the lower deck of the pallet of FIG. 6.

Referring to FIGS. 10 and 12, a series of ribs are formed on the underside of upper deck 10. Some of these ribs form a central, square recess 14 with rounded corners. Other ribs form a circular recess 16 at each corner of the deck. Still other ribs form oblong recesses 18 with rounded ends at the mid-point of each side of the deck. As described below, these nine recesses are adapted to receive the upper ends of nine supports which are integrally molded with lower deck 40. The areas between the recesses are fork-receiving regions which are intended to rest on the forks of a fork lift that can engage the pallet from any side.

Other ribs on the underside of upper deck 10 form an orthogonal pattern which runs parallel and perpendicular to the sides of the deck, while still other ribs form another orthogonal pattern that is set at 45° to the first pattern. These ribs collectively form interconnected girder-like structures which span the spaces between the support-receiving recesses 14, 16 and 18. As can be seen in FIG. 8, the underside of upper deck 10 is substantially planar, i.e., substantially all of the ribs on its underside terminate in a common plane.

In each of the recesses 14, 16, 18 are four depending snap tabs 20. Details of snap tabs 20 can be seen in FIGS. 17 and 18. Each has a flexible shank portion 22 and a tapered tip 24 with a shoulder 26 which snaps under a lip of the mating support of lower deck 40. Adjacent each snap tab 20 in the circular corner recesses 16 is a small arcuate slot or hole 28. A similar but rectangular slot or hole 30 lies adjacent each snap tab 20 in the other recesses 14, 18. Slots 28, 30 facilitate formation of the snap tabs during the molding operation, and also allow insertion of a separation tool which can be used to depress the snap tabs and separate the upper and lower decks if desired.

Lower deck 40 has a perimeter which substantially matches the perimeter of upper deck 10. Referring to FIGS. 13–16, lower deck 40 comprises a rectangular perimeter base 42 and an integrally formed X-shaped central base 44. Bases 42 and 44 have beveled edges 46, and oblong apertures 48.

Four corner supports 50 project upwardly from lower deck 40 at the corners thereof. Supports 50 have a circular cross section and a frustoconical shape, with the base wider than the top. Four medial side supports 52 project upwardly from the sides of perimeter base 42. Side supports 52 are oblong in cross section with rounded ends, and also are tapered, with the wider portion at the bottom. A large central support 54 projects upwardly from the center of central base 44. Central support 54 has a generally square cross section with rounded corners, and also is tapered with the wider portion at the bottom. The corners of central support 54 protrude into the large openings 56 in lower deck 40 which are defined by the intersecting base portions 42, 44.

Figure 17:
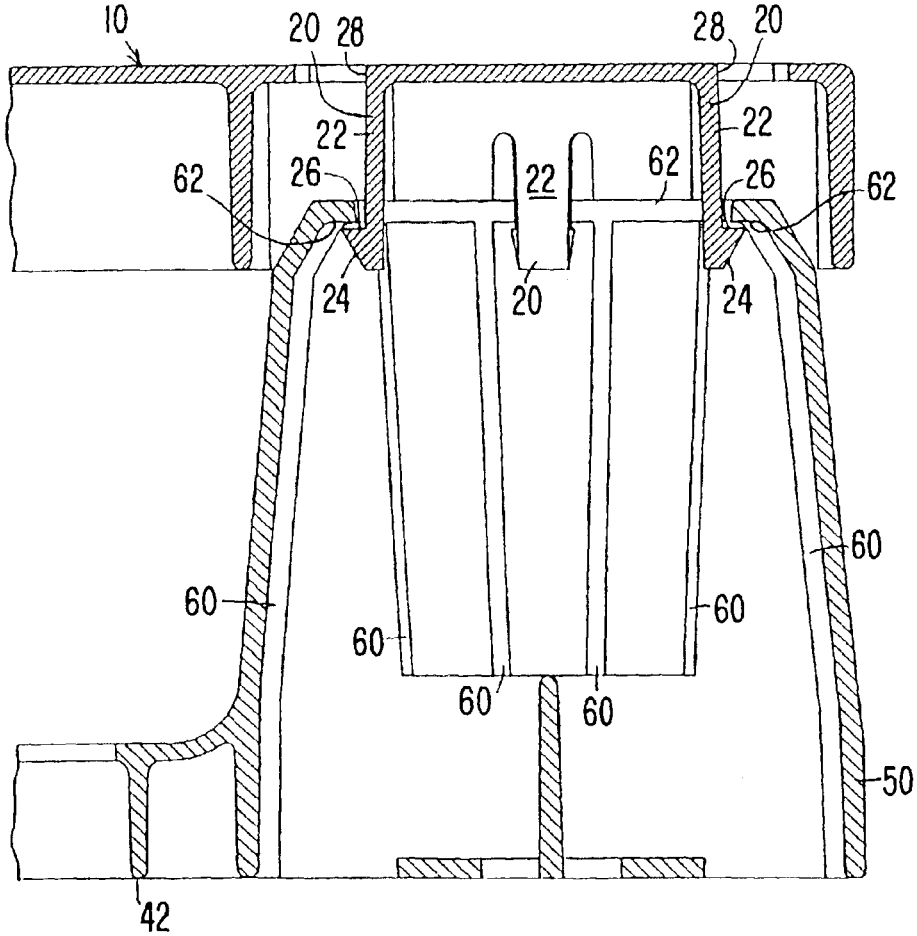
FIG. 17 is a partial sectional view taken along line 17—17 in FIG. 1.
Figure 18:
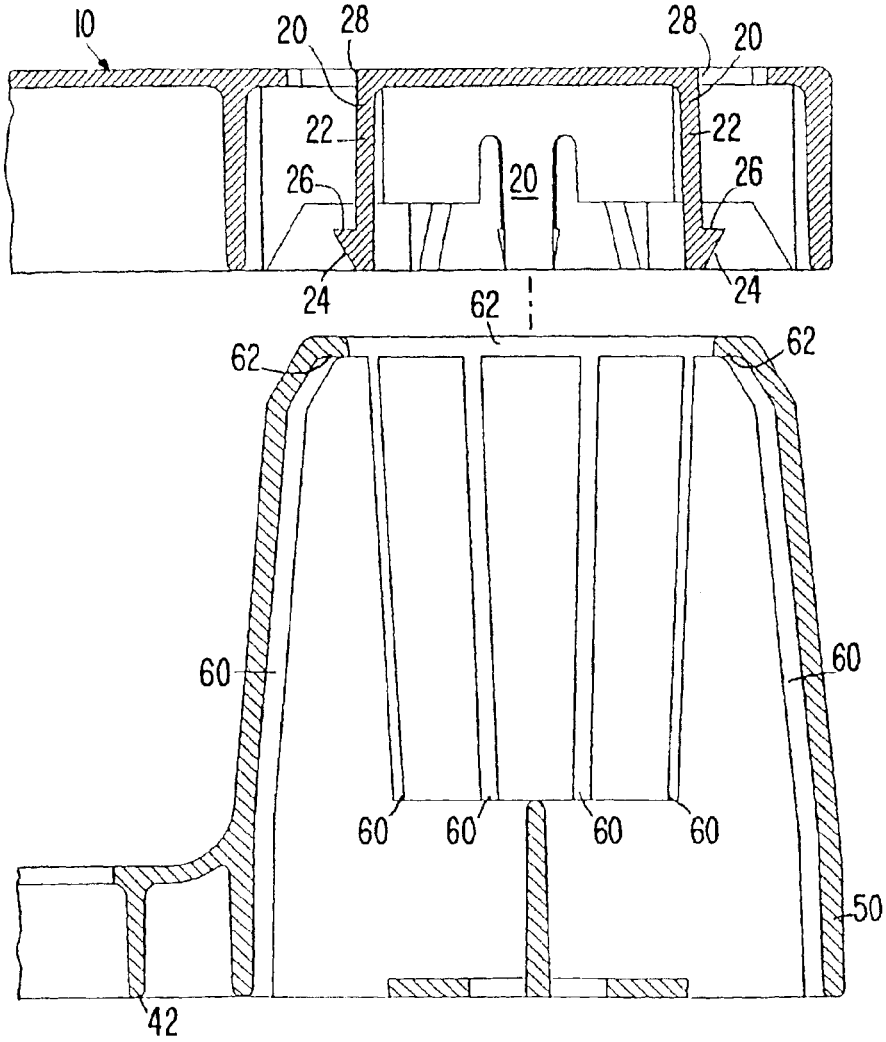
FIG. 18 is a partial sectional view taken along line 18—18 in FIG. 6.

Each support 50, 52, 54 is hollow, and has internal upright stiffening ribs 60, which project inwardly from the side wall of the support. The upper end of each support is turned inwardly to form a horizontal peripheral lip 62. Referring to FIGS. 17 and 18, when the upper and lower decks are pressed together during assembly, the sloped portion 24 of each snap tab 20 rides past lip 62, causing the snap tab to bend inwardly. When shoulder 26 clears lip 62, the snap tab springs outwardly to be captured beneath lip 62.

Figure 14:
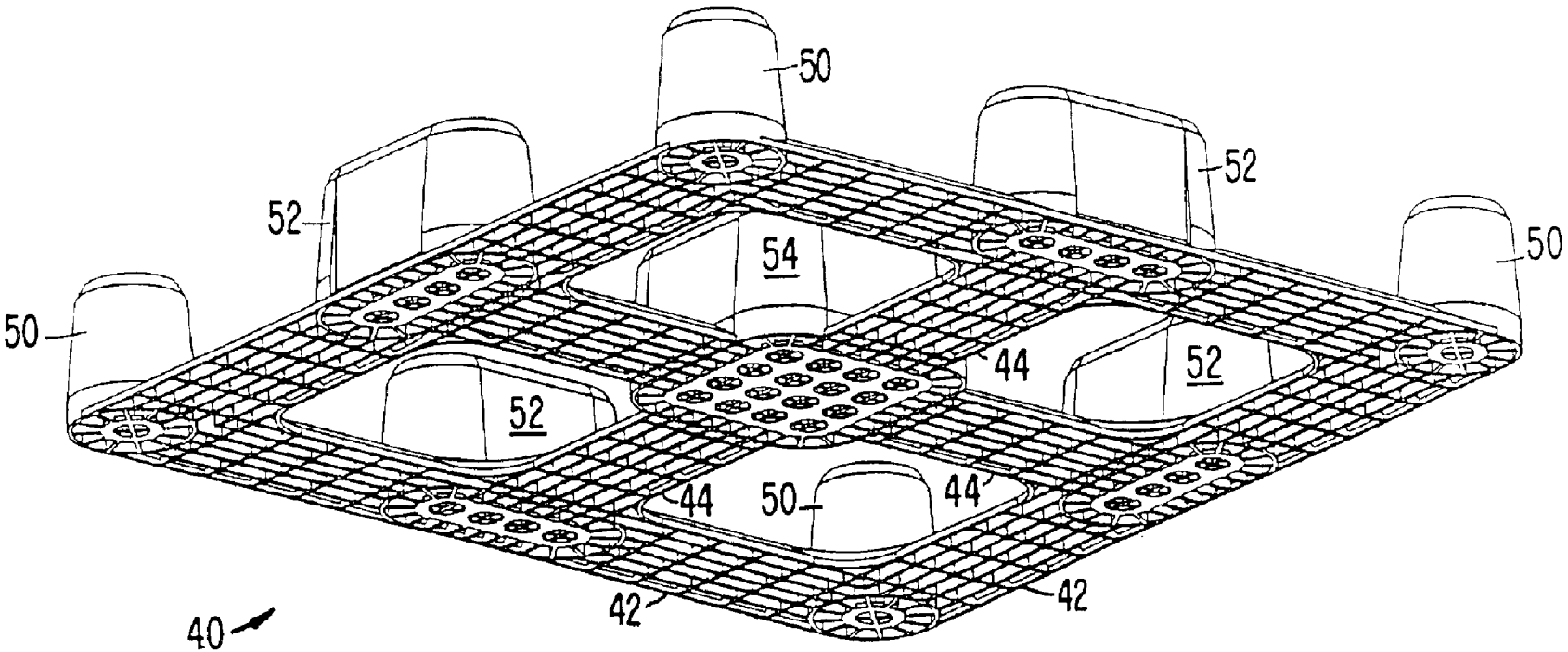
FIG. 14 is a bottom perspective view of the lower deck of FIG. 13.
Figure 15:
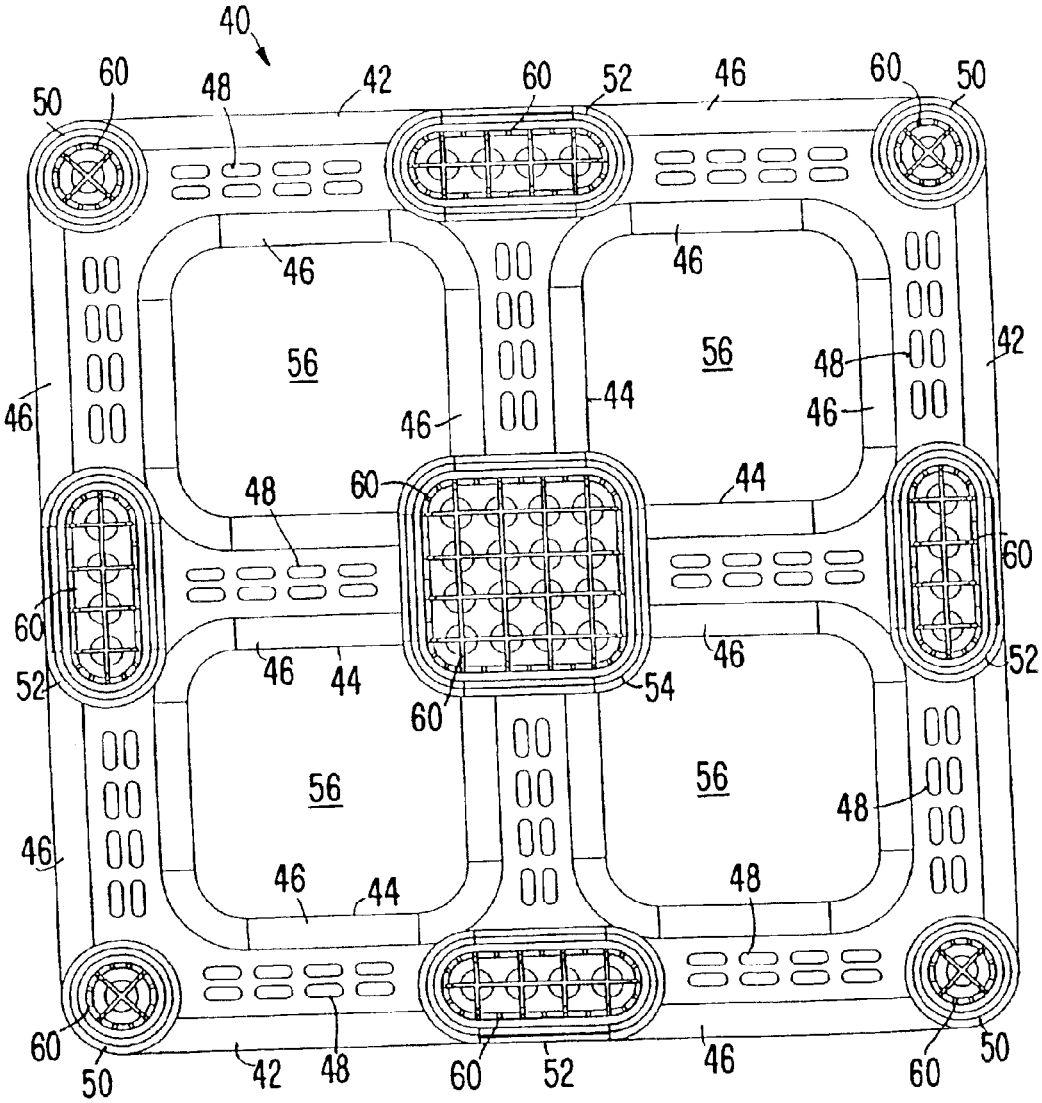
FIG. 15 is a top plan view of the lower deck of FIG. 13.
Figure 16:
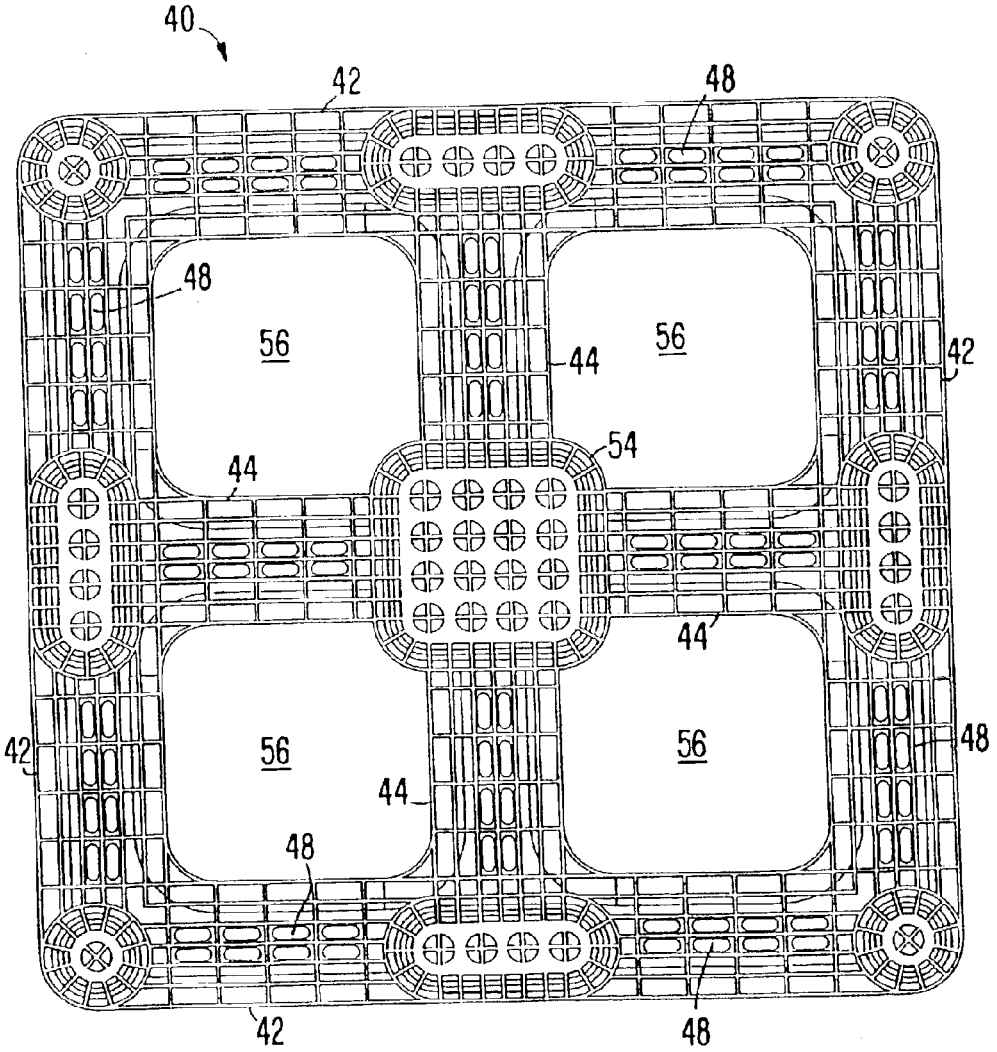
FIG. 16 is a bottom plan view of the lower deck of FIG. 13.

As seen in FIGS. 14 and 16, the underside of lower deck 40 has several series of reinforcing ribs which provide structural rigidity to the base portions 42, 44, and properly distribute the load carried by the upper deck 10 and the supports 50, 52, 54. In the regions which underlie the supports, the ribbing is more closely spaced than elsewhere in the base portions. This arrangement better distributes the load from the top of the pallet, and also makes the pallet better suited for use in the bottled beverage industry, where one loaded pallet may be placed directly on top of the bottle closures of bottles carried by another pallet. All spaces between the ribs on the underside of lower deck 40 are sized to prevent the smallest bottle closures (approximately 28 mm) from fitting between the ribs.

Figure 19:
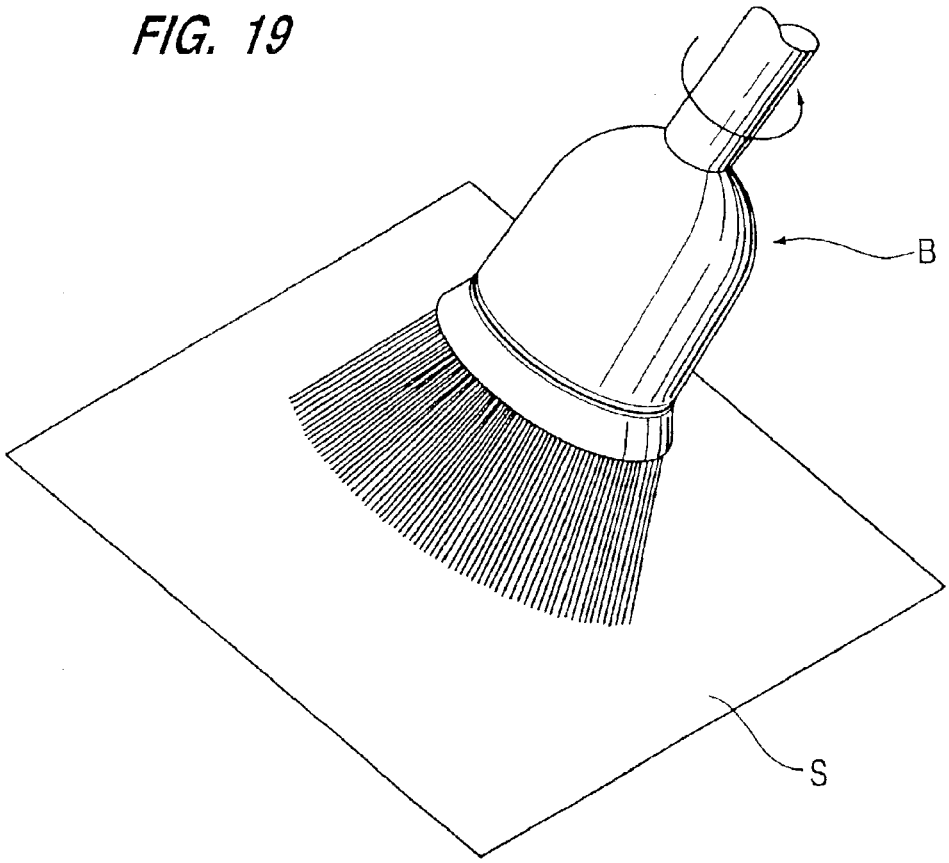
FIG. 19 is a schematic perspective view of a method for scuffing selected surfaces of the pallet.

The synthetic resins used to form the pallet typically have a rather slippery surface finish when the pallet is new. This is undesirable in certain critical areas, viz., the top of the upper deck 10, the underside of the lower deck 40, and the underside of upper deck 10 in the regions between the supports, which rest on the forks of a fork lift. In accordance with the invention (see FIG. 19), these critical areas are subjected to an anti-slip treatment which comprises wire brushing the surfaces S, preferably with at least one rotating cup-shaped wire brush B, to produce a scuffed texture having a multi-directional scuffing pattern. This is done before the upper and lower decks are joined together. The anti-slip characteristics of this scuffed surface do not appear to degrade over time because normal use and handling of the pallet appears to subject the surfaces to additional scuffing as the pallet is loaded, unloaded, and moved about.

The advantages of the pallet according to the invention will be readily apparent to those skilled in the art. The symmetrical two-piece injection molded plastic construction affords substantial strength and durability, simplicity, and easy assembly. The snap tabs 20 are protected from damage prior to assembly because they are recessed into the upper deck. A substantial amount of open area strategically placed within the structure minimizes the amount of material required, without comprising structural rigidity. The tapered shape of the supports allows for easy assembly, and good load dispersion from the upper deck to the lower deck. The supports have smooth, rounded outsides to prevent damage from the forks of a fork lift. The top deck completely covers the supports, preventing debris from collecting in the hollow areas. The pallet is easy to keep clean and wash because all of the exposed support ribs are on the underside of both decks, and there are no crevices to collect dirt or water. The bottom of the lower deck is designed to transfer the load evenly to bottle closures when pallets loaded with beverage bottles are stacked on one another. In particular, the critical load areas beneath the supports are heavily reinforced with a maximum surface area to evenly load the layer of bottles on the pallet below. Finally, the anti-slip scuffed surface treatment is a simple, long-lasting and reliable solution to the problem of slippery decks and fork contacting surfaces.

While a square pallet has been illustrated and described in the preferred embodiment, other shapes, e.g., rectangular, would suffice while still embodying the features of the invention. The cross sectional shapes of the supports 50, 52, 54 also may vary somewhat from those shown. Other modifications will be apparent to those skilled in the art without departing from the true spirit and scope of the invention, which is limited only by the appended claims.

What is claimed is:

1. A synthetic resin pallet, for use with a fork lift, comprising separately molded upper and lower decks spaced apart by a plurality of supports to define therebetween fork-receiving regions, wherein a surface of one of the upper and lower decks is substantially planar and includes recesses, a plurality of snap tabs spaced about a periphery of each recess and the supports are integrally formed with and project generally perpendicular from the other of the upper and lower decks and are secured to the surface of the one deck, the supports being tapered and having an integrally-molded first end and a second end, wherein one of the first and second ends of the supports is wider than the other of the first and second ends thereof, and wherein the second end of the each support is retained in the recess by the plurality of snap tabs.

2. The pallet of claim 1, wherein the first end of the supports is wider than the second end.

3. The pallet of claim 2, wherein the snap tabs snap-actingly engage the supports in the recesses when the upper and lower decks are assembled.

4. The pallet of claim 1, wherein one of the supports is located substantially at the center of the pallet, and the other supports are located substantially at the periphery of the pallet, the central support being the largest support.

5. The pallet of claim 4, wherein the pallet is generally rectangular with nine supports between the decks, one support being located at each corner of the pallet, and one support being located medially of each side of the pallet, the supports defining two fork-receiving regions for forks entering from each side of the pallet.

6. The pallet of claim 5, wherein the lower deck comprises a generally rectangular perimeter base from which the peripheral supports project, and an integrally formed X shaped central base from which the central support projects, the central joining with the perimeter base medially of each side thereof.

7. The pallet of claim 6, wherein the perimeter base and the central base define four large openings through the lower deck.

8. The pallet of claim 1, wherein each of the supports has a side wall, and has in its interior upright stiffening ribs which project inwardly from said side wall.

9. A synthetic resin pallet, for use with a fork lift, comprising separately molded upper and lower decks spaced apart by a plurality of supports to define therebetween fork-receiving regions, wherein a one side of an underside of the upper deck and upperside of the lower deck is substantially planar and includes at least one snap tab in each of a plurality of recesses, and the supports are integrally formed with and project upwardly from the other side of the underside of the upper deck and upperside of the lower deck, and are secured to the one side, the supports having lower ends and upper ends, one of the ends of the supports being received in the recesses in the one side with the at least one snap tab being received within an interior of the support such that a side wall of the support is between the at least one snap tab and an inner surface of the recess at least partially circumscribing the recess, wherein the supports are tapered, one of the lower and upper ends of the supports is wider than the other of the lower and upper ends thereof.

10. The pallet of claim 9, wherein each of the supports is hollow and has in its interior upright stiffening ribs which project inwardly from said side wall.

11. The pallet of claim 9 wherein the side wall of each support circumscribes the interior of the support.

12. A synthetic resin pallet, for use with a fork lift, comprising separately molded upper and lower decks spaced apart by a plurality of supports to define therebetween fork-receiving region, each support including a side wall defining a support interior, a lip extending inwardly into the support interior to retain the upper deck to the lower deck, wherein one side of the underside of the upper deck and the upperside of the lower deck is substantially planar, and the supports are integrally formed with and project from an other side of the underside of the upper deck and the upperside of the lower deck, and are secured to the one side, one of the supports being located substantially at the center of the pallet, and the other supports are located substantially at the periphery of the pallet.

13. A pallet according to claim 12 wherein the underside of the perimeter base and the underside of the central base have reinforcing ribs, some of said reinforcing ribs lying beneath the supports, the reinforcing ribs beneath the supports being more closely spaced than elsewhere in the perimeter base and the central base.

14. A pallet according to claim 12 wherein the central support is the largest support, wherein the pallet is generally rectangular, one support being located at each corner of the pallet, and one support being located medially of each side of the pallet, and wherein the corner supports are circular in cross-section, the medial side supports are oblong in cross-section with rounded ends in the areas adjacent the fork-receiving regions, and the central support is rectangular in cross-section with rounded corners.

15. A pallet according to claim 14 wherein the supports are tapered, the lower ends of the supports being wider than the upper ends thereof.

16. A pallet according to claim 15 wherein the top of the perimeter base and the top of the central base have beveled edges.

17. A pallet according to claim 16 wherein each of the supports is hollow, has a side wall, and has in its interior upright stiffening ribs which project inwardly from said side wall.

18. A pallet according to claim 14 wherein the top of the perimeter base and the top of the central base have beveled edges.

19. The pallet of claim 1 wherein the supports each include an outer wall at least substantially circumscribing an interior of the support.

20. The pallet of claim 19 wherein each support includes a lip extending inwardly from the outer wall, and wherein the snap tabs engage the lips on the supports to attach the upper deck to the lower deck.

21. The pallet of claim 19 wherein the plurality of supports includes at least four corner supports, at least four medial supports and a center support, wherein the corner supports have a substantially circular cross section having a first radius, wherein the medial supports have a substantially oblong cross section having a first dimension substantially equal to the first radius and a second dimension perpendicular to the first dimension, wherein the second dimension is substantially larger than the first radius and the first dimension, and wherein the center support has a cross section with two perpendicular dimensions each substantially equal to the second dimension.

22. The pallet of claim 1 wherein the snap tabs extend away from the one of the upper and lower decks.

23. The pallet of claim 22 wherein each recess includes an inner surface abutting an outer surface of the outer wall of the support and wherein the support is between the inner surface and the snap tabs when the upper deck is attached to the lower deck.

24. The pallet of claim 23 wherein at least one support has a substantially circular cross section and at least one support has an oblong cross section.

25. A synthetic resin pallet for use with a fork lift comprising:

a synthetic resin first deck having a plurality of recesses each defined by an inner surface at least substantially circumscribing the recess, at least one arm projecting from the first deck in each recess;

a synthetic resin second deck molded separately from the first deck; and a plurality of hollow supports projecting substantially perpendicularly from the second deck and defining fork-receiving regions therebetween, each support including an outer wall at least substantially circumscribing an interior of the support, each support received within one of the plurality of recesses in the first deck to space the first deck away from the second deck, the at least one arm received within the interior of the support to secure the first deck to the second deck.

26. The pallet of claim 25 wherein the plurality of supports are integrally-molded with the second deck.

27. The pallet of claim 25 wherein the outer wall of each support circumscribes the interior of the support.

28. The pallet of claim 27 wherein the supports are tapered from one of the first deck and the second deck to the other of the first deck and the second deck.

29. The pallet of claim 25 wherein each support includes a retaining surface projecting inwardly from the outer wall, and wherein each arm includes at least one snap tab for engaging the retaining surface on one of the plurality of supports to attach the first deck to the second deck.

30. The pallet of claim 29 wherein the at least one arm is spaced inwardly of the inner surface of the recess and includes the snap tab at an outer end of the arm, and wherein the snap tab snap-actingly engages the retaining surface of the support to attach the support to the recess.

31. The pallet of claim 30 wherein at least one of the plurality of supports has a substantially circular cross section and at least one of the plurality of supports has an oblong cross section.

32. A synthetic resin pallet for use with a fork lift comprising:

a synthetic resin first deck having a plurality of recesses, at least one snap-tab in each recess and not protruding outside the recess;

a synthetic resin second deck molded separately from the first deck; and a plurality of hollow supports projecting substantially perpendicularly from the second deck and defining fork-receiving regions therebetween, each support including an outer wall at least partially defining an interior of the support, each support received within one of the plurality of recesses in the first deck to space the first deck away from the second deck, each snap tab secured to one of the plurality of supports to secure the first deck to the second deck.

33. The pallet of claim 32 wherein each recess is defined by an inner surface circumscribing the recess, the snap-tab extending from the first deck but not extending past a plane defined by an outer edge of the inner surface.

34. The pallet of claim 33 wherein the outer wall of each support circumscribes the interior of the support, each snap-tab disposed within the interior of the support to secure the first deck to the second deck.

35. The pallet of claim 34 wherein the supports are tapered from one of the first deck and the second deck to the other of the first deck and the second deck.

* * * * *